United States Patent [19]

Weyant, Jr.

[11] Patent Number: 5,071,402

[45] Date of Patent: Dec. 10, 1991

[54] CENTRIFUGE ROTOR HAVING SPILLAGE CONTAINMENT GROOVE

[75] Inventor: Oakley L. Weyant, Jr., Southbury, Conn.

[73] Assignee: E. I. Du Pont de Nemours and Company, Wilmington, Del.

[21] Appl. No.: 892,263

[22] Filed: Aug. 4, 1986

[51] Int. Cl.[5] ..... B04B 5/02; B04B 7/02

[52] U.S. Cl. ..... 494/16

[58] Field of Search ..... 494/16, 18, 17, 19, 494/20, 21, 33

[56] References Cited

U.S. PATENT DOCUMENTS

| | | | |
|---|---|---|---|
| 3,586,484 | 6/1971 | Anderson | 494/33 X |
| 3,674,198 | 7/1972 | Eberle | 494/20 X |
| 3,819,111 | 6/1974 | Romanauskas et al. . | |
| 3,863,049 | 1/1975 | Hinman | 494/33 X |
| 3,901,434 | 8/1975 | Wright | 137/525 X |
| 4,202,487 | 5/1980 | Edwards . | |
| 4,360,151 | 11/1982 | Cowell et al. . | |
| 4,372,483 | 2/1983 | Wright | 484/16 |
| 4,375,272 | 3/1983 | Sutton, III | 494/16 |
| 4,484,906 | 11/1984 | Strain | 494/16 |

*Primary Examiner*—Harvey C. Hornsby
*Assistant Examiner*—Scott J. Haugland

[57] ABSTRACT

A centrifuge rotor has a continuous annular groove disposed radially outwardly of each of the sample receiving cavities provided in the rotor. The groove collects any liquid spilled during operation of the rotor thereby to prevent the liquid from draining into the cavities and contaminating the same as the rotor slows.

7 Claims, 2 Drawing Sheets

CENTRIFUGE ROTOR HAVING SPILLAGE CONTAINMENT GROOVE

BACKGROUND OF THE INVENTION

1. Field of the Invention

The present invention relates to a centrifuge rotor and, in particular, to a centrifuge rotor having a liquid containment arrangement adapted to contain any liquid spilled within the rotor and to prevent contamination of the centrifuge by that spilled liquid.

2. Description of the Prior Art

A centrifuge rotor is a device adapted to expose a sample carried in a suitable sample container to a predetermined centrifugal force field. This field is achieved by causing the rotor to rotate at a selected angular velocity, typically in the range from ten thousand to approximately eighty thousand revolutions per minute.

The rotor is provided with an annular array of sample receiving cavities which are disposed concentrically about the axis of rotation of the rotor. If the longitudinal axis of each of the cavities is inclined toward the rotational axis of the rotor, the device is known as a fixed angle rotor.

The samples are each contained in a container which, in the typical application, is closed by a suitable capping arrangement. The capping arrangement is necessary in the event that the sample is a biologically hazardous material to insure that the sample is appropriately isolated from the environment.

When the sample is not hazardous the capping arrangement may be omitted so long as the operator fills the tube only to a predetermined level. It should be noted that since the tubes are received in the inclined cavities in the rotor the predetermined level to which the tube is filled lies some distance below the rim of the tube. Care must be exercised to insure that the tube is filled only to this level to guard against the possibility that centrifugal force effects will cause the contents of the tube to overflow and spill from the inclined tube when the tube is inserted into the rotor and rotated to its operational speed.

The containers are themselves susceptible to rupture. Thus, even if a capping arrangement has been used, and even if the operator has exercised care to introduce only the proper volume of liquid into the container, there still may occur instances in which the liquid contents of the tube will spill into the rotor.

As a further precaution to prevent the egress of the spilled liquid from the rotor, a cover may be provided over the rotor. The cover has a depending skirt which seats against an upstanding rim of the rotor. When secured in place the skirt and the rim cooperate to confine the liquid within the rotor. Exemplary of such a structure is the device shown in U.S. Pat. No. 3,819,111 (Romanauskas et al.), assigned to the assignee of the present invention. U.S. Pat. No. 4,202,487 (Edwards) and U.S. Pat. No. 4,360,151 (Cowell et al.) describe other rotor covers for use in a centrifuge instrument.

A cover may itself become dislodged from the rotor due to the centrifugally induced force of the spilled liquid acting against the underside of the cover. Structural arrangements which eliminate this occurrence by isolating the cover from the spill are known in the art. U.S. Pat. No. 4,372,483 (Wright) discloses a centrifuge rotor having an annular liquid containment lip machined into the body of the rotor above the tube cavities. The lip serves to confine any liquid present due to container rupture, cap leakage or inadvertent excessive filling. The annular lip extends radially inwardly to overlie a portion of the cavities to confine any liquid liberated into the body of the rotor. The lip prevents the liquid from contacting and exerting pressure on the cover of the rotor.

Although each of the above discussed alternatives appears to adequately confine any spilled liquid to the interior of the rotor, none of these expedients confronts or solves the problem of contamination of the rotor by the spilled liquid as the rotor slows to a stop. For example, if a tube ruptures and the containment annulus shown in the last-mentioned patent functions in the intended manner then the spilled liquid is confined on the interior of the rotor. However, as the rotor slows the liquid drains down from the region of the confinement lip into the cavities and onto the other containers carried in the rotor. It is possible that the draining liquid may possibly enter into the other containers, thus compromising the contents of these containers. The draining liquid may also contaminate other parts of the rotor, making subsequent handling of the containers and the rotor itself more difficult or more hazardous for the operator.

In view of the foregoing it is believed advantageous to provide a centrifuge rotor which, in the event of liquid spillage, serves to prevent the contamination of other rotor cavities, other containers or the interior of the rotor.

SUMMARY OF THE INVENTION

A centrifuge rotor having a rotor body is provided with an annular array of cavities formed therein. Each cavity is oriented at a predetermined angle with respect to the axis of rotation of the rotor. Each cavity is sized to receive a container carrying a sample of a liquid, the container being susceptible to rupture, leakage or overfilling such that liquid may be spilled therefrom. As the rotor is rotated any spilled liquid responds to centrifugal force to displace radially outwardly of the cavities.

In accordance with the present invention the rotor body has a groove formed therein. The groove is arranged to surround the radially outer periphery of the tube cavities such that as the rotor slows any spilled liquid drains into and is contained within the groove. As a consequence the spilled liquid is prevented from entering into the cavity in the body of the rotor.

In the preferred embodiment the groove is continously circumferentially disposed about the rotor body. The groove is defined in the body by a pair of concentric sidewalls machined in the rotor body. The walls are joined by a contiguous bottom wall. A plurality of recesses, each communicating with the groove, may be optionally formed in the body of the rotor. The recesses enlarge the effective volumetric capacity of the groove.

In an alternate embodiment the groove may be defined by a plurality of discontinous groove segments. Each segment surrounds one of the cavities at the radially outer periphery thereof. Each of the segments may be provided with a recess, if desired.

BRIEF DESCRIPTION OF THE DRAWINGS

The invention will be more fully understood from the following detailed description thereof taken in connection with the accompanying drawings which form part of this application and in which.

DETAILED DESCRIPTION OF THE INVENTION

Figure 1:
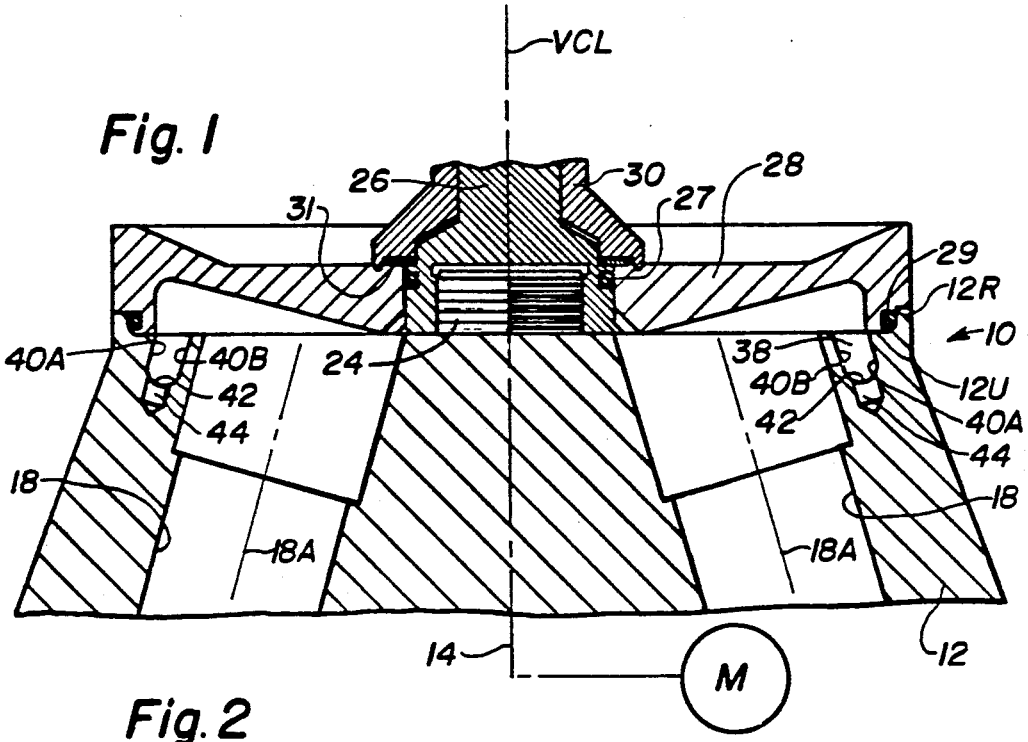
FIG. 1 is a partial side elevation entirely in section illustrating a centrifuge rotor having a spillage containment groove in accordance with the present invention.

Throughout the following detailed description similar reference characters refer to similar elements in all figures of the drawings.

With reference to FIG. 1 shown in side elevational view entirely in section is a portion of a centrifuge rotor 10 in accordance with the present invention. The rotor 10 is defined by a relatively massive body portion 12 formed from a high strength material such as titanium. The rotor body 12 has a planar upper surface 12U extending peripherally about the open top of the rotor. The radially outer peripheral edge of the upper surface 12U of the body of the rotor 10 defines an upstanding rim 12R.

The rotor 10 is connected by a suitable drive connection shown schematically at 14 to a motive source M whereby motive energy may be applied to the rotor 10 to cause the same to rotate about the axis of rotation VCL in a manner understood by those skilled in the art. Although for purposes of description the rotor discussed herein is designed for use in an ultracentrifuge instrument typically operated at a speed in excess of fifty thousand revolutions per minute it should be understood the the present invention may be used with a rotor operable at any rotational speed.

A plurality of cavities 18 is arranged in an substantially annular array in the body 12. Each of the cavities 18 is machined into the body 12 such that the axis 18A of each cavity defines a predetermined angle with respect to the axis of rotation VCL. Each of the cavities 18 is sized and configured to receive a container 20 (shown in FIGS. 2 through 4) carrying a sample of a liquid to be subjected to a centrifugal force field. Each of the containers 20 may be provided with a suitable capping assembly (not shown) whereby the contents of the container 20 is secured therewithin. The container 20 may nevertheless be susceptible to rupture due to stresses associated with high speed rotor operation. The capping assembly, if one is provided, may also be subject to leakage.

The body 12 has an upstanding threaded boss 24 formed thereon. The boss 24 may receive a threaded core 26 about which an annular disc-like cover 28 is received. A seal 27 is trapped between the cover 28 and the core 26. A seal 29 extends about periphery of the cover 28. A cover clamp 30 with a washer 31 is threaded to the core 26 thereby to secure the cover 28 in position over the body 12 of the rotor with the edge of the cover 28 engaging the rim 12R, as shown in the Figures. Details of the cover and its mounting arrangement are disclosed in U.S. Pat. No. 3,819,111, assigned to the assignee of the present invention. This patent is hereby incorporated by reference herein. Any other suitable cover arrangement may be utilized and remain within the contemplation of the present invention.

As noted earlier the container and/or capping assembly (if one is provided) have a susceptibilty for rupture or leakage. As a result there is a possibility for liquid to be liberated within the rotor during a centrifugation run. Unless precautions are taken this liquid may contaminate the remaining containers and/or cavities of the rotor.

In accordance with the present invention a spillage containment groove 38 is disposed in the body 12 of the rotor 10. In the preferred instance the groove 38 is a continuous annular trench-like region extending completely about the interior of the body 12 near the upper surface 12U and radially outwardly of the cavities 18. The groove 38 is formed in any convenient manner, as by machining. The groove 38 is defined by a pair of radially spaced outer and inner walls 40A and 40B, respectively. The lower edges of the walls are joined by a contiguous bottom wall 42. The walls 40A and 40B may lie at the same predetermined angle with respect to the axis of rotation as do the cavities 18.

Figure 5:
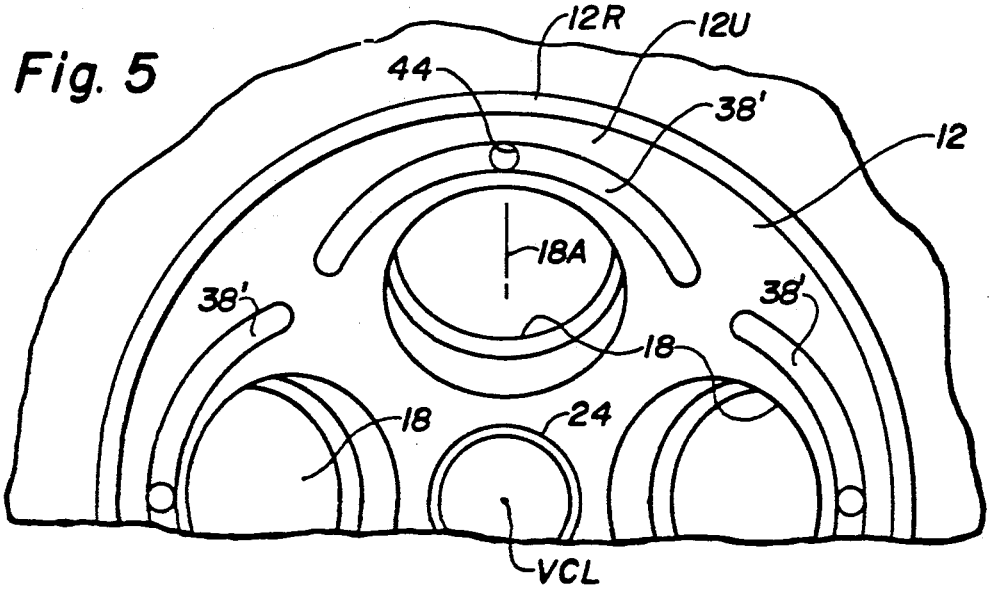
FIG. 5 is a plan view of a portion of the rotor of FIG. 1 illustrating an alternate embodiment of the present invention; and, FIG. 6 is a side elevation view, in section, illustrating the disposition of the spillage containment grove in accordance with the present invention in a rotor having a annular containment lip machined therein.

It should be understood that the groove 38 need not extend in a concentric circular configuration. Thus, the groove 38, although continuous, may extend sinuously about the periphery of the body of the rotor, so long as the groove 38 surrounds the radially outer peripheral portions of the cavities 18. Nor is it necessary that the groove 38 extend continuously about the interior of the rotor. For example, as seen in FIG. 5, it is within the contemplation of this invention to provide a plurality of groove segments 38' in the rotor, with each segment 38' surrounding the radially outer periphery of the mouth of each cavity 18 in the rotor. Each groove segment 38' is disposed radially outwardly of the mouth of one of the cavities 18. With such an arrangement each groove segment 38' serves to guard the mouth of the cavity 18 about which it is disposed and to prevent the entry of liquid thereinto.

Further in accordance with the preferred embodiment an array of auxiliary recesses 44 may be bored into the body of the rotor in a manner whereby the recesses 44 communicate with the groove 38. The recesses 44 are angularly spaced about the body 12 of the rotor 10. The groove 38 is sized to receive a predetermined volume of liquid for a purpose more fully explained herein. The presence of the optional recesses 44 further enlarges the available volumetric capacity of the groove 38.

Figure 2:
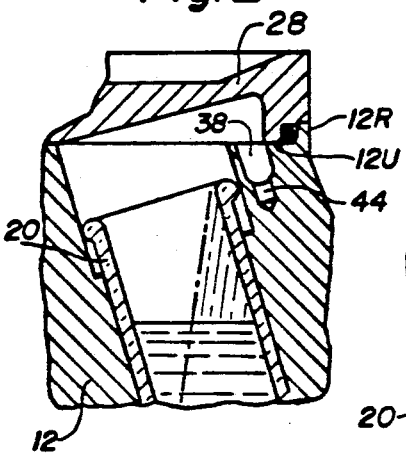
FIGS. 2, 3 and 4 are enlarged views illustrating the sequence of events when spillage of the contents of a tube occurs and the containing action performed by a rotor having a containment groove in accordance with the present invention.
Figure 3:
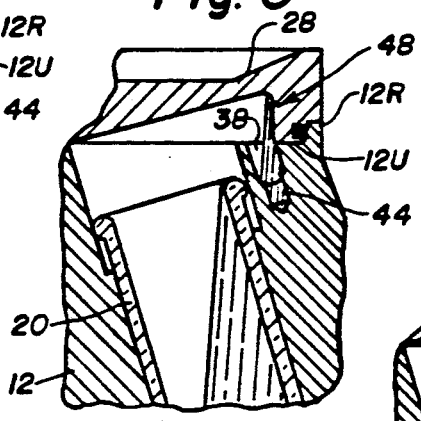

In operation each of the containers 20 is inserted into its associated cavity 18 in the body 12 of the rotor 10. The container 20 may be capped, as discussed, or may be simply inserted into the rotor in an uncapped condition. In the latter event the operator must be careful to introduce into the container only a predetermined amount of liquid so that under maximum centrifugal force the upper edge of the liquid in a given container will not extend past the upper edge of the container. Such a condition is illustrated in FIG. 2 where the position of the upper level of a proper volume of the liquid with the rotor at rest is shown in solid lines while the position of the proper volume of liquid at maximum rotational speed is shown in dot-dash lines.

However, it may occur in some instances that the operator may err when filling the container 20. Alternately it may occur that a capping assembly, if one is provided, may be improperly secured to the container 20, or may leak. It could also occur that the container 20 itself may rupture. From whatever the source there may be a situation in which liquid is liberated within the rotor. In such an event the liquid is urged by centrifugal force radially outwardly to occupy a position such as shown at 48 in FIG. 3. The liquid is confined within the rotor by the action of the cover 28.

Figure 4:
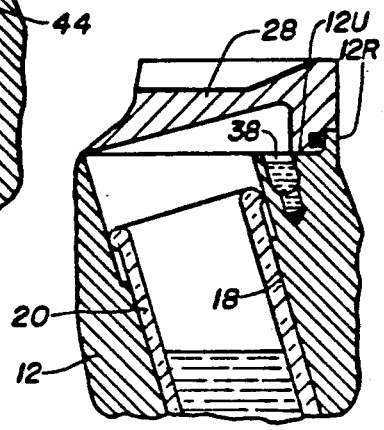

As the rotor slows the effects of centrifugal force on the liquid diminish. The liquid drains into and is received by the groove 38 (FIG. 4). This action prevents the liquid from returning into the individual cavities 18 in the rotor, thus preventing the contamination thereof and/or the containers 20 carried therein. By appropriately configuring the groove 38 a predetermined volume of spilled liquid may be contained thereby. As a result the deleterious effects of contamination of the remaining containers and/or cavities are avoided.

Figure 6:
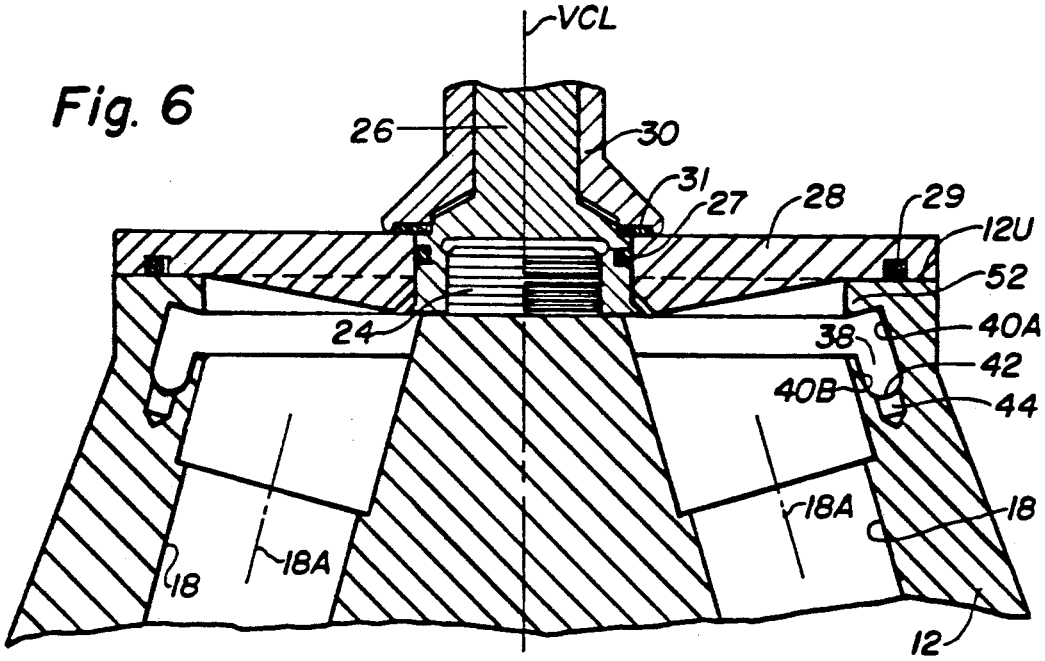

As is seen from FIG. 6 the present invention may be used with a rotor of the type in which a containment lip 52 is provided circumferentially about the rotor. The lip 52 serves the same purpose as the cover, i.e., confinement of the liberated liquid on the interior of the rotor, but this purpose is effected without exposing the cover itself to pressure or loading due to the liquid. In any event, however, the action of the groove 38 is the same. As the liquid drains the groove 38 collects the liquid and prevents its entry into the cavities of the rotor.

The structure of the rotor in accordance with the present provides a suitably sized and configured spillage containment groove, either in a continuous or segmented arrangement, whereby any liquid present in the rotor from whatever the cause may be contained to prevent the deleterious effects of contamination thereby.

Those skilled in the art. having benefit of the teachings of the present invention as hereinabove set forth, may effect numerous modifications thereto. Those modifications are, however, to be construed as lying within the contemplation of the present invention, as defined by the appended claims.

What is claimed is:

1. A centrifuge rotor having a body portion having an upper surface thereon with at least one cavity formed therein, the cavity being sized to receive a container carrying a sample of a liquid, the body having a circumferentially disposed groove disposed therein, the groove being disposed radially outwardly of the cavity and near the upper surface of the body, the groove being arranged such that any liquid released during the operation of the centrifuge from a container within a cavity will drain into the groove as the rotor slows to a stop, wherein the groove comprises a plurality of discontinuous groove segments.

2. The centrifuge rotor of claim 1 further comprising a recess formed into the body of the rotor, the recess communicating with the groove.

3. The centrifuge rotor of claim 1 wherein the rotor body has an annular array of cavities formed therein, the groove being disposed radially outwardly of the cavities.

4. A centrifuge rotor having a rotor body having an upper surface thereon with an annular array of cavities formed therein, each cavity being sized to receive a container carrying a sample of a liquid, the container being susceptible to rupture or overfilling such that liquid may be spilled therefrom, any liquid spilled from a container received within one of the cavities being responsive to centrifugal force as the rotor is rotated to displace radially outwardly of the cavities, the rotor body having a circumferentially disposed groove formed therein, the groove having a predetermined volume and being located in a predetermined position near the upper surface of the rotor body such that any liquid from a container received within one of the cavities drains into and is contained within the groove as the rotor slows thereby to prevent the spilled liquid from entering any of the cavities in the body of the rotor, wherein the groove comprises a plurality of discontinous segments arranged in the body of the rotor.

5. The centrifuge rotor of claim 4 wherein the groove is defined by a pair of radially spaced sidewalls joined by a contiguous bottom wall, the bottom wall having an array of recesses disposed at predetermined angular spacings, each of the recesses communicating with the groove, the recesses and the groove combining to define a volumetric capacity greater than that of the groove.

6. A centrifuge rotor having a rotor body portion having an upper surface thereon with an annular array of cavities formed therein, each cavity being sized to receive a container carrying a sample of a liquid, the container being susceptible to rupture or overfilling such that liquid may be spilled therefrom, any liquid spilled from a container received within one of the cavities being responsive to centrifugal force as the rotor is rotated to displace radially outwardly of the cavities, the rotor body having a circumferentially disposed groove disposed therein, the groove having a predetermined volume and being located in a predetermined position near the upper surface of the rotor body such that any liquid from a container received within one of the cavities drains into and is contained within the groove as the rotor slows thereby to prevent the spilled liquid from entering any of the cavities in the body of the rotor, wherein the groove is defined by a pair of radially spaced sidewalls joined by a contiguous bottom wall, the bottom wall having an array of recesses disposed at predetermined angular spacings, each of the recesses communicating with the groove, the recesses and the groove combining to define a volumetric capacity greater than that of the groove.

7. A centrifuge rotor having a rotor body having an upper surface thereon with an annular array of cavities formed therein, each cavity being sized to receive a container carrying a sample of a liquid, the container being susceptible to rupture or overfilling such that liquid may be spilled therefrom, any liquid spilled from a container received within one of the cavities being responsive to centrifugal force as the rotor is rotated to displace radially outwardly of the cavities, the rotor body having a circumferentially disposed groove formed therein, the groove extending continuously about the body of the rotor, the groove having a predetermined volume and being located in a predetermined position near the upper surface of the rotor body such that any liquid from a container received within one of the cavities drains into and is contained within the groove as the rotor slows thereby to prevent the spilled liquid from entering any of the cavities in the body of the rotor, wherein the groove is defined by a pair of radially spaced sidewalls joined by a contiguous bottom wall, the bottom wall having an array of recesses disposed at predetermined angular spacings, each of the recesses communicating with the groove, the recesses and the groove combining to define a volumetric capacity greater than that of the groove.

* * * * *